United States Patent [19]

Meyer

[11] 3,955,235

[45] May 11, 1976

[54] SCAVANGING APPARATUS FOR AN ELECTROSTATIC COPIER

[75] Inventor: Daniel Richard Meyer, Boulder, Colo.

[73] Assignee: International Business Machines Corporation, Armonk, N.Y.

[22] Filed: July 7, 1975

[21] Appl. No.: 593,918

[52] U.S. Cl. ..... 15/256.52; 355/15

[51] Int. Cl.[2] ..... G03G 13/00

[58] Field of Search ..... 15/1.5, 256.51, 256.52; 315/3 DD, 15; 118/637; 134/1

[56] References Cited

UNITED STATES PATENTS 3,615,813 10/1971 Clarke et al. ..... 355/15

OTHER PUBLICATIONS

IBM Technical Disclosure Bulletin, Vol. 15, No. 12, May 1973.

*Primary Examiner*—Edward L. Roberts

*Attorney, Agent, or Firm*—Herbert F. Somermeyer

[57] ABSTRACT

Within a cleaning station for an electrostatic copier, a rotatable scavanging roll has a peripheral scavanging surface. Particulate matter, including toner entrained in an air stream, passes by the scavanger roll; the roll being electrically charged attracts a portion of the entrained particulate material. An air permeable filter is in cleaning contact with one circumferential portion of the scavanger roll for at least partially cleaning particulate matter therefrom, while simultaneously capturing entrained particulate material not attracted to the scavanging roll. In a preferred form, the cleansing filter has a relatively coarse mesh adjacent and contacting the scavanging roll and at an air-receiving portion. The filter has an exit portion of relatively fine mesh for capturing all particulate material.

4 Claims, 4 Drawing Figures

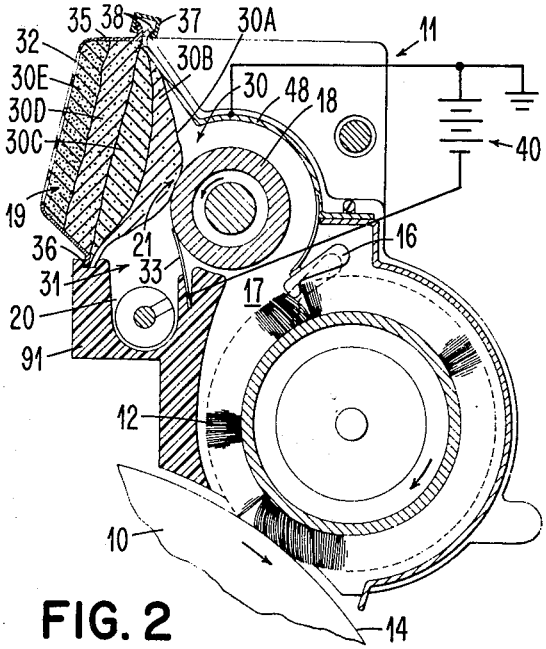
FIG. 2
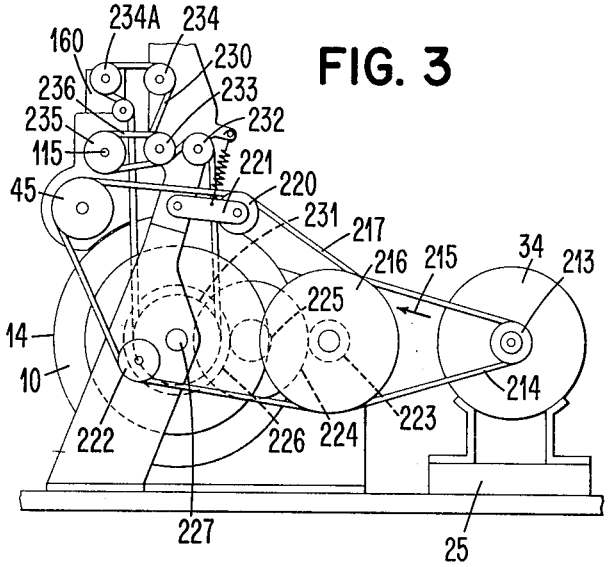
FIG. 3
FIG. 4
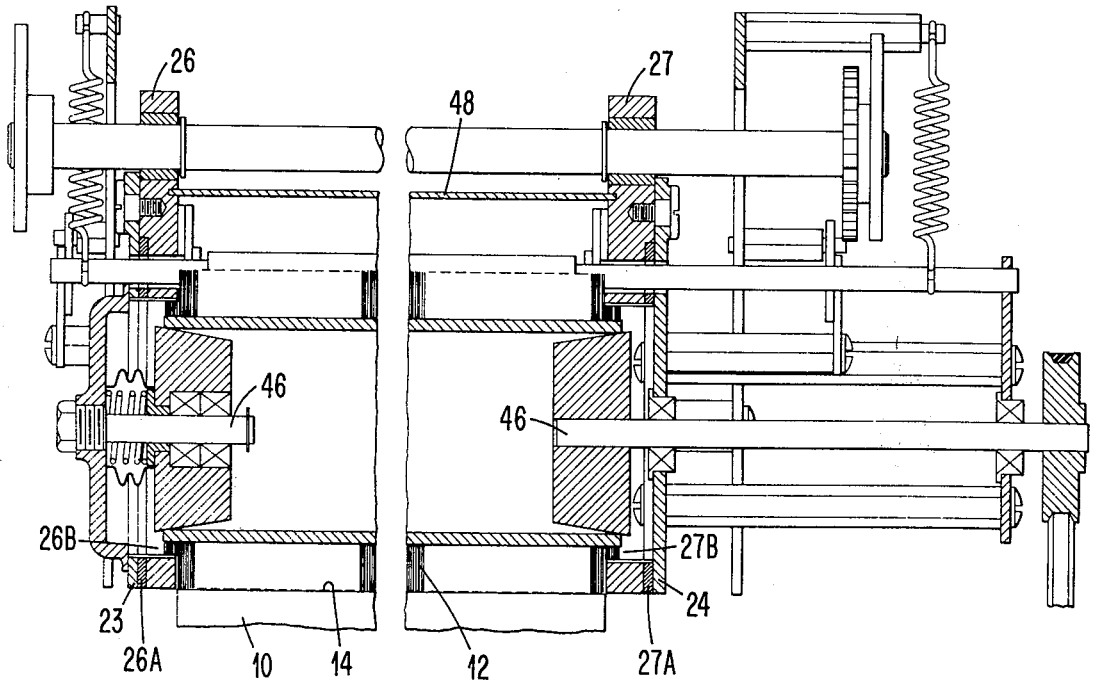

SCAVANGING APPARATUS FOR AN ELECTROSTATIC COPIER

BACKGROUND OF THE INVENTION

The present invention relates to electrostatic type copiers, and more particularly to an electrostatic copier having an improved toner and particulate matter cleaning station.

Copying or duplicating machines employing electrostatic principles have been employed for the last several years. One of the problems presented in constructing such a copying machine is removal of the toner particles from a photoconductor drum and returning such removed toner particles to a reservoir, while simultaneously separating other particulate matter from the toner to prevent contamination. Such separation requires efficient filtering and scavanging techniques.

SUMMARY OF THE INVENTION

It is an object of the present invention to provide a simple, but enhanced, scavanging operation which prevents contamination of toner being returned to a reservoir while collecting other particulate matter to prevent machine contamination.

A machine constructed in accordance with the present invention includes a scavanging station having a rotatable scavanging roll; a housing enclosing the roll with spaced-apart inlet and outlet openings, the housing being radially spaced from the roll to leave an air chamber therebetween, and an air chamber separator disposed in the housing intermediate the inlet and the outlet and extending radially from said housing into partial cleaning contact with the scavanging roll and having a filter means for collecting particulate matter received through the inlet opening and not adhering to the scavanging surface, while simultaneously limiting particles on the scavanging surface to those electrostatically adhereing thereto for removal by another operation.

In a preferred form of the invention, the air separating means consist of a filter having relatively coarse mesh adjacent and contacting the scavanger roll with successive layers of increasingly fine mesh toward an outlet portion whereat the finest mesh collects very nearly all expected particulate matter, for example, collects up to 99.96%.

The foregoing and other objects, features, and advantages of the invention will be apparent from the following more particular description of the preferred embodiment, as illustrated in the accompanying drawing.

THE DRAWING

FIG. 1 is a simplified diagrammatic perspective view of a cleaner station from a copier such as that shown in U.S. Pat. No. 3,758,774, which incorporates the present invention.

FIG. 2 is a diagrammatic cross-sectional enlarged view of the FIG. 1 illustrated apparatus taken in the direction of the arrows along line 2—2 and showing the preferred construction of the present invention.

FIG. 3 is a diagrammatic showing of a drive mechanism for a copier incorporating the invention.

FIG. 4 is a simplified diagrammatic showing of the FIG. 1 illustrated apparatus as taken in the direction of the arrows along line 4—4 of FIG. 1.

DETAILED DESCRIPTION

Figure 1:
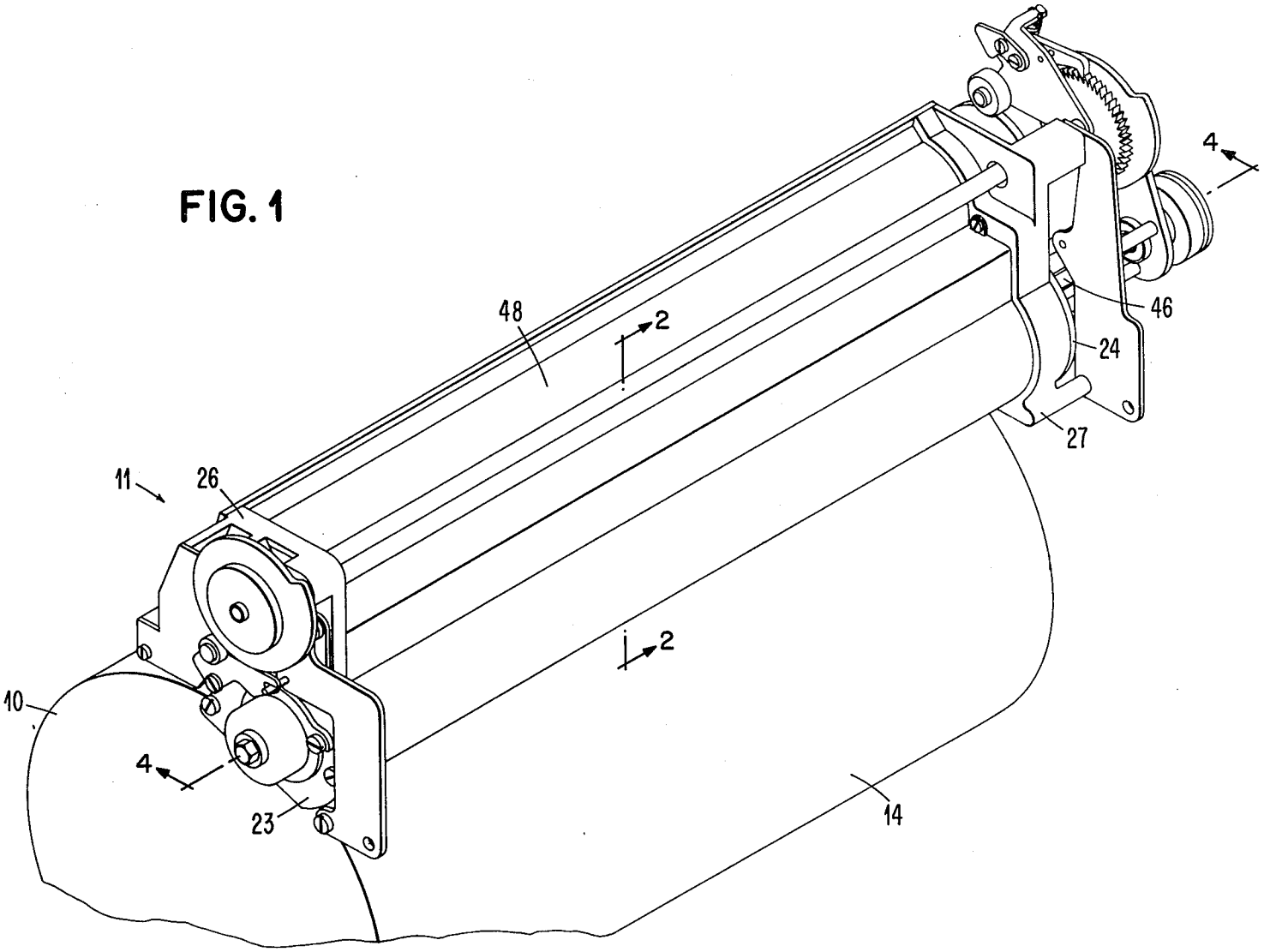

Referring now more particularly to the drawing, like numerals indicate like parts and structural features in the various views. The invention is preferably practiced in a so-called "electrostatic" copier or duplicating machine such as that shown in FIG. 1 of U.S. Pat. No.3,758,774. The present invention is on apparatus improving a cleaning station 17 of the referenced patent. Cleaning station 11 of the present disclosure compares favorably to station 17 of U.S. Pat. No. 3,758,774. In general, it includes fiber cleaning brush 12 rotatable as indicated by the arrow and being in cleaning contact with a surface 14 of drum 10. Both the brush 12 and drum 10 simultaneously and synchronously rotate in the direction of the indicated arrows (FIG. 2). Residual toner on surface 14 is removed by rotation of cleaning brush 12 with respect to drum 10 and entrained in air impelled by brush 12 rotation through entrance 17 (FIG. 2) to scavanging chambers which include rotatable scavanging roll 18. Included in the scavanging chambers is filter 19 which filters particulate material not attracted to the electrically charged roll 18. Below the scavanging chambers is a toner recovery area 20 which returns scavanged toner to a toner reservoir in the copier for reuse. In accordance with the present invention, filter 19 is in cleaning and rubbing contact with scavanger roll 18 at 21, the contact being along the entire axial length of scavanger roll 18. Such contact tends to remove particulate material from roll 18 while dividing the scavanging chamber inside housing 48 into upper high pressure chamber 30 and lower pressure chamber 31.

In a constructed embodiment of cleaning station 11, rotatable cleaning brush 12 and knock-off bar 16 were adjustably mounted by first and second brush mounting plates 23 and 24 (FIG. 4). Plates 23 and 24 are, in turn, adjustably mounted on machine frame 25 and, in particular, on upstanding end blocks 26 and 27 secured to and forming a part of the machine frame 25. The arrangement is such that as the rotation of cleaning brush 12 impacts the fibers against toner knock-off bar 16, brush 12 releases particulate material into scavanging chamber 30.

In the scavanging chamber, electrically charged scavanging roll 18 attracts the oppositely charged toner particles. Other particles either are maintained entrained in the air and trapped by filter 19 in the upper air chamber 30 or carried to scavanger roll 18. Filter 19 is in rubbing contact with the surface of scavanger roll 18 dividing the scavanging chamber into two separate air chambers 30 and 31. Lower air chamber 31 has a lower air pressure than upper chamber 30. The main exit for air impelled into the scavanging chamber is through filter 19 and then to atmosphere via large rectangularly elongated exit ports 32. The preferred rubbing engagement between filter 19 and the surface of scavanging roll 18 is such that toner particles electrically adhering to the surface of roll 18 are not removed by such contact. Other particulate matter which does not have the opposite charge of the toner particles has less electrical-caused adherents and tends to be removed by such rubbing contact. The toner particles remaining on scavanging roll 18 are removed from the surface by the scraping contact of doctor bar 33. Such toner particles drop into toner recovery area 20 from whence they travel through an auger to a toner reservoir (not shown) for reuse in the copying machine. The photoconductor drum 10, fiber cleaning brush 12, and scavanging roll 18 all are driven by a single motor 34 via a later-described drive system. Each time a copy is to be made, actuation of the copier machine by a push-button (not shown) activates single motor 34 to simultaneously rotate drum 10, brush 12, and roll 18. Brush 12 and scavanger roll 18 mount for rotation in housing 48 in an air-sealed relationship to movable plates 23, 24 and end blocks 26, 27. Any rotary air-sealing arrangement, as is known in the arts, may be employed. Further, housing 48 extends between end blocks 26, 27 to seal 30, 31 as best seen in FIG. 4. Plates 23, 24 are in contact with end blocks 26, 27 seals 26A, 27A to seal ends of brush 12. Brush 12 extends axially into 26, 27 as at 26B, 27B. Brush 12 is mounted for rotation on split shaft 46 (FIG. 4) as will become more clear.

In accordance with the present invention, scavanging operations are further enhanced by constructing filter 19 with graded texture; the coarsest texture being at cleaning surface 30A and the finest texture at exit pot 32. Grading the texture from surface 30A to port 32 has several advantages. A relatively coarse texture at cleaning surface 30A facilitates partial cleaning action at the rubbing contact of area 21 of scavanging roll 18. A second advantage is that the efficiency of filter 19 for collecting particulate matter is enhanced. Small particulate matter flows through the air permeable filter to a finer-textured portion, while larger particulate matter is captured and held in the filter closer to cleaning surface 30A. In this manner, debris accumulation in filter 19 is distributed throughout the filter yielding longer filter life.

In constructing filter 19, rather than having a linear grading of texture from cleaning surface 30A to exit port 32, a plurality of filter material layers of differing textures is preferably employed. In one constructed embodiment, an outer cleaning layer 30B had the coarsest texture filter material. A next layer 30C had an intermediate, but finer, texture than layer 30B. Similarly, layer 30D had yet finer texture, with the finest texture being in layer 30E.

Since filter 19 efficiently collects particulate matter from upper cleaning chamber 30, replaceability is an important feature. To this end, port 32 is formed by a removable cover plate 35 pivotably placed in receiving slot 36 of insulating member 91, which forms a portion of the scavanging station and insulatively supports scavanging roll 18, as well as toner recovery area 20. The upper end portion of cover plate 35 is spring clipped to housing 48 by elongated tubular spring clip 37.

To remove a filter 19 from scavanging station 11, spring clip 37 is first slid longitudinally off housing 48 and cover plate 35. Cover plate 35 is pivoted outwardly and lifted from pivot groove 36. Filter 19 is then removed from station 11. A new filter is placed in station 11. Cover plate 35 is then reinserted into pivot groove 36 and pivoted against housing 48. At this time, spring clip 37 is again slipped over housing 48 and cover member 15 retaining fingers 38.

The scavanging voltage for roll 18 is provided by a DC source 40. Source 40 has a positive grounded connection to housing 48 and a negative scavanging connection to doctor bar 33 mounted in insulating member 91. Good contact between bar 33 and scavanging roll 18 provides good electrical connection thereto. Roll 18 is insulatively mounted for rotation such that a static electric field attracts particulate toner material in the scavanging apparatus.

Referring now briefly to FIG. 3, the drive system for operating scavanging station 11 and the remainder of the copier (not shown) is described. Motor 34 is suitably mounted on machine frame 25. Motor output pulley 213 drives a first belt 214 in the direction of arrow 215. Main power transfer pulley 216, driven by belt 214, drives power distribution belt 217. Idler pulley 220 on spring-loaded idler arm 221 keeps belt 217 at a suitable tension. Belt 217 directly drives fiber cleaning brush 12 via brush drive pulley 45. Belt 217 then travels over idler pulley 222. A set of photoconductor drum 10 driving gears 223, 224, 225, and 226 drivingly engage main drive pulley 216 with the drum; gear 223 is on pulley 216, while gear 226 is secured to shaft 227 of drum 10. Roll 18 is driven via intermediate drive belt 230 extending from driving pulley 231 on shaft 227, thence over idler pulley 232, pulley 233, pulley 234, and finally back to driving pulley 231. The scavanger roll is mounted on shaft 115 which mounts pulley 235 and is driven by belt 236 extending from pulley 235 to pulley 233. A copier operations counter 160 is actuated by a pulley 234A driven by drive belt 230. Counter 160 is useful for tallying the number of machine operations for metering purposes, as well as for maintenance control purposes beyond the scope of the present description.

While the invention has been particularly shown and described with reference to a preferred embodiment thereof, it will be understood by those skilled in the art that various changes in form and detail may be made therein without departing from the spirit and scope of the invention.

What is claimed is:

1. Improved scavanging apparatus including in combination:

an elongated rotatable scavanging roll having an axially elongated peripheral scavanging surface;

a housing enclosing said roll and having spaced-apart inlet and outlet openings elongated in a direction parallel with said roll, said housing being spaced radially from said roll to leave an air chamber therebetween and being in an air-sealing relation at the axial ends of said scavanging roll, said inlet and outlet openings being circumferentially spaced apart with respect to said scavanging surface, said roll being rotatable past said inlet opening in a first direction toward and past said outlet opening;

an elongated doctor blade in said housing and in cleaning contact with said scavanging surface length adjacent said outlet;

the improvement including in combination:

air chamber separator means disposed in said housing intermediate said inlet and said outlet along said first direction and extending radially toward said roll from said housing into partial cleaning contact with said scavanging surface and having filter means whereby particulate matter received through said inlet opening and not adhering to said scavanging surface is collected by said filter means.

2. The scavanging apparatus set forth in claim 1 wherein said filter means has a graded texture with a coarset texture engaging said scavanging surface and extending inside said housing and being graded to a finer texture from said housing, said finer texture being an air-outlet portion of said housing.

3. The scavanging apparatus set forth in claim 2 wherein said filter means comprises a plurality of layers of filter material each having a different texture, the layer in contact with said scavanging surface having a coarset texture and a layer adjacent said outlet having the finest texture.

4. The scavanging apparatus set forth in claim 1 wherein said housing includes an insulating member disposed below said scavanging roll for supporting same, said insulating member having an elongated pivot slot extending parallel to said scavanging roll;

said housing also including a conductive member extending over said scavanging roll, said conducting member having an elongatedB finger disposed above said scavanging roll;

a removable apertured filter-retaining plate elongated in a direction parallel to said scavanging roll and having a lower port pivotably residing in said elongated pivot slot and having an upper portion with a mating finger abutting said elongated finger of said conducting member; and an elongated spring clip disposed over said finger for retaining said cover plate onto said housing such that said filter means is pressed against said scavanging roll for forming two elongated chambers in said scavanging apparatus.

* * * * *